United States Patent [19]

Hufnagl

[11] 4,308,705

[45] Jan. 5, 1982

[54] REINFORCING ELEMENT

[76] Inventor: Walter Hufnagl, Lommelstrasse 9, 8000 München 71, Fed. Rep. of Germany

[21] Appl. No.: 18,889

[22] Filed: Mar. 9, 1979

Related U.S. Application Data

[63] Continuation of Ser. No. 849,967, Nov. 9, 1977, abandoned.

[30] Foreign Application Priority Data

Nov. 9, 1976 [DE] Fed. Rep. of Germany ..... 2651119

[51] Int. Cl.[3] ..... E04C 3/30; D02G 3/00

[52] U.S. Cl. ..... 52/734; 52/738; 428/587; 52/740; 428/397; 428/398; 428/399; 428/592

[58] Field of Search ..... 428/397, 398, 399, 573, 428/574, 575, 587, 592, 595; 52/734, 735, 736, 737, 740, 738

[56] References Cited

U.S. PATENT DOCUMENTS

| | | | |
|---|---|---|---|
| 1,399,701 | 12/1921 | Dyson | 52/736 |
| 2,142,758 | 1/1939 | Ossoinack | 52/736 X |
| 2,376,761 | 5/1945 | Fahy | 52/738 |
| 3,978,760 | 9/1976 | Muenchinger | 428/593 X |
| 3,979,186 | 9/1976 | Mizuma | 29/183.5 |
| 4,119,764 | 10/1978 | Mizuma et al. | 52/737 X |

FOREIGN PATENT DOCUMENTS

| | | | |
|---|---|---|---|
| 204749 | 8/1959 | Austria | 52/736 |
| 213363 | 2/1961 | Austria . | |
| 1035606 | 8/1958 | Fed. Rep. of Germany . | |
| 1084464 | 6/1960 | Fed. Rep. of Germany . | |
| 1139352 | 11/1962 | Fed. Rep. of Germany . | |
| 2033759 | 1/1972 | Fed. Rep. of Germany . | |
| 1484229 | 6/1976 | Fed. Rep. of Germany . | |
| 721927 | 6/1952 | United Kingdom | 52/736 |
| 711327 | 8/1954 | United Kingdom | 52/736 |

*Primary Examiner*—William R. Dixon, Jr.
*Attorney, Agent, or Firm*—Michael J. Striker

[57] ABSTRACT

A reinforcing rod or wire is formed with a plurality of helical and longitudinally continuous grooves. At least one of these grooves is of varying width and/or depth, and similarly may have a varying cross-sectional shape.

8 Claims, 10 Drawing Figures

Fig.1a
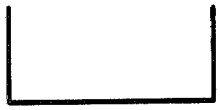
Fig. 2a
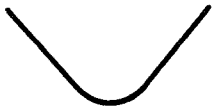
Fig.3a
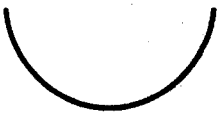
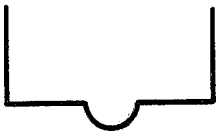
Fig.4a
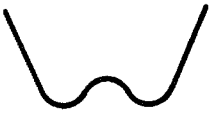
Fig.5a
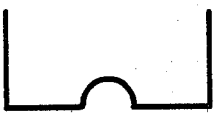
Fig.6a

REINFORCING ELEMENT

This is a continuation of application Ser. No. 849,967, filed Nov. 9, 1977, now abandoned.

CROSS-REFERENCE TO RELATED APPLICATIONS

This application is related to the commonly owned and copending patent applications Ser. Nos. 849,968; 849,469 filed jointly herewith, whose entire disclosures are herewith fully incorporated by reference.

BACKGROUND OF THE INVENTION

The present invention relates to a reinforcing element. More particularly this invention concerns a profiled rod or wire used as reinforcement in concrete.

A reinforcing rod or wire for use in concrete invariably has profilings or a formed surface so that the element can hold well in the concrete. It is known to form this element with a succession of distinct circumferential ribs. Another method uses a rotatable carrier on which is mounted a plurality of rollers that themselves are driven. This carrier rotates about an axis along which a rod is passed while the rollers are driven so as to form at least one generally helical groove in the element being profiled. Such an apparatus is described in the above-mentioned copending and jointly filed application by Walter Hufnagl et al.

Such rods, as shown in German Pat. Nos. 1,084,464 and 1,484,229 as well as in Austrian Pat. No. 213,363 and German published specifications Nos. 1,035,606; 1,139,352; 1,153,402 and 2,033,759 have grooves or formations of regular section throughout which are formed by uniformly shaped rollers. They do not hold well in concrete, and the tools used to make them tend to have a relatively short service life due to the type of profiling.

SUMMARY OF THE INVENTION

It is therefore an object of the present invention to provide an improved reinforcing element.

Yet another object is to provide such a reinforcing element which can be made with minimal wear to the tools profiling it.

Yet another object is to provide such a reinforcing element wherein the particular characteristics of the material constituting the element are most advantageously exploited.

These objects are attained according to the present invention in an elongated reinforcing element of the above-described general type having one generally helically extending and outwardly open groove which has a predetermined width and a predetermined depth. This groove extends continuously the full length of the element at an acute angle to the longitudinal axis of the element and according to this invention the width and/or depth of the groove varies along the element.

According to further features of this invention at least two such grooves are provided, one of which may be of regular cross-sectional shape and the other of which may be of varying cross-sectional shape as described above. The element is formed between these grooves with a rib which therefore also is of varying cross-sectional shape throughout its length.

The reinforcing element made according to this invention can be produced with very little wear by the rollers forming the groove or grooves. The two grooves can be of different shape and varying cross-sections.

According to another feature of this invention the groove can be V-shaped, of semi-circular cross-section, of double semi-circular cross-section, sinuous or rounded, or formed of trapezoidal or square section.

Furthermore this reinforcing element according to the present invention is made in a machine wherein a plurality of rollers rotatable about respective roller axes are peripherally engaged with the reinforcement element and orbited around this reinforcement element as it is pulled through a head or carrier carrying these rollers. The feed rate and rotation rate are so adjusted that the grooves run at an angle between 40° and 50°, preferably 45°.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1*a*–6*a* illustrate possible cross-sectional shapes of grooves according to this invention.

DESCRIPTION OF THE PREFERRED EMBODIMENTS

Figure 1:
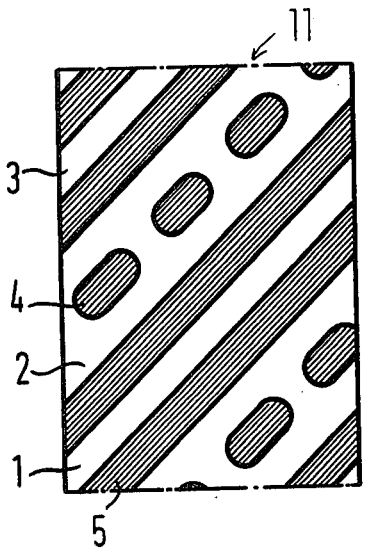
FIGS. 1–4 are schematic plan views illustrating portions of reinforcement elements according to this invention.

As shown in FIG. 1 a reinforcing element 11 a portion of whose surface is shown in flattened out condition for clarity of view has a first helically extending groove 1 that lies at an angle of approximately 45° to the longitudinal axis of the element 11. Another groove 3 of identical and regular cross-section is separated from the groove 1 by ribs 5 also of regular cross-sectional shape. The element 11 is further formed with a groove 2 having periodically raised formations or lands 4 that give this groove 2 a varying cross-sectional shape. Such an element 11 is formed in a machine as described above in the above-cited copending application by means of three rolls carried on a rotatable carrier and themselves rotatable about respective axes.

Figure 2:
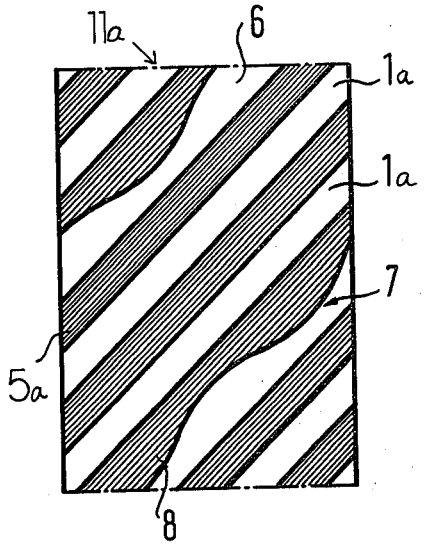

FIG. 2 shows an element 11*a* having two grooves 1*a* identical to the grooves 1 and 3 of FIG. 1 and separated by regular-section ridges 5*a*, and with a groove 7 of sinusoidal shape and forming a ridge 8 of similarly sinusoidal shape.

Figure 3:
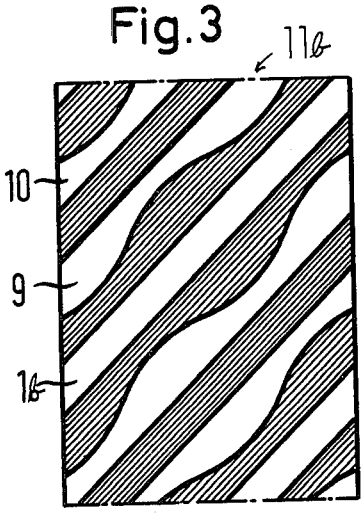

It is also possible to form an element 11*b* as shown in FIG. 3 with two sinusoidal-shaped grooves 9 and 10 and a single regular-section groove 1*c*.

Figure 4:
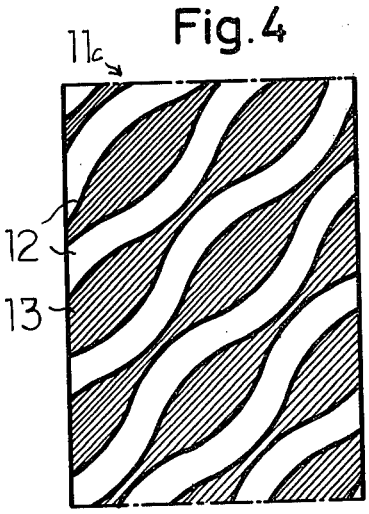

FIG. 4 shows an arrangement wherein all of the grooves 12 are of sinusoidal shape on both sides and flank ridges 13 of similarly sinusoidal shape. In this arrangement the element 11*c* therefore has grooves which vary with respect to depth rather than with respect to width.

FIG. 1*a* shows how the groove may be of rectangular section. In FIG. 2*a* the groove is generally V-shaped but has a rounded root. The groove of FIG. 3*a* is of semi-circular section.

It is also possible as shown in FIG. 4*a* to form the groove of generally square section but with a semi-circular recess in the bottom. A semi-circular boss could also be provided in the bottom of the square-section groove as shown in FIG. 6*a*.

FIG. 5*a* shows generally V-shaped groove with a wide root and a semi-circular boss in this space. All of these formations are made by rollers and any of the corners may be rounded or straight if desired. It is possible for the width as well as the length of the groove to vary, and for the groove to change cross-sectional shape from one region to another. Appropriate profiling of the respective forming roll makes this possible.

It will be understood that each of the elements described above, or two or more together, may also find a useful application in other types of structures differing from the types described above.

While the invention has been illustrated and described as embodied in a reinforcing element, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An elongated reinforcing element, comprising a rod having a longitudinal axis and formed with at least two continuously and helically extending grooves each having two outwardly open ends and predetermined width and depth dimensions, said grooves extending at 45° to said longitudinal axis of said element, at least said width dimension of at least one of said grooves varying periodically along the length of said one groove.

2. The element defined in claim 1, wherein two such grooves are provided, said element being formed between said grooves with a rib.

3. The element defined in claim 1, wherein said groove is of varying cross-sectional shape.

4. The element defined in claim 1, wherein said depth dimension varies along said element.

5. The element defined in claim 1, wherein said groove is of V-section.

6. The element defined in claim 1, wherein said groove is of part-circular section.

7. The element defined in claim 1, wherein said element is steel.

8. The element defined in claim 1, wherein said width of the other of said grooves is uniform substantially along the length of said groove.

* * * * *